United States Patent [19]

Cooper et al.

[11] Patent Number: 4,463,231

[45] Date of Patent: Jul. 31, 1984

[54] PUSH-PUSH SWITCH

[75] Inventors: Steven R. Cooper, Elkhart, Ind.; Thomas W. Flanders, Edwardsburg, Mich.; David M. Hughes, Elkhart, Ind.

[73] Assignee: CTS Corporation, Elkhart, Ind.

[21] Appl. No.: 411,655

[22] Filed: Aug. 26, 1982

[51] Int. Cl.[3] ..... H01H 13/64

[52] U.S. Cl. ..... 200/153 J

[58] Field of Search ..... 200/153 J, 328, 153 L, 200/153 LB, 159 A, 156, 283, 284, 11 G, 11 K, 6 B

[56] References Cited

U.S. PATENT DOCUMENTS

| | | | |
|---|---|---|---|
| 2,945,111 | 7/1960 | McCormick | 200/153 J |
| 3,204,067 | 8/1965 | Brown | 200/156 |
| 3,226,991 | 1/1966 | Hartsock | 200/153 J |
| 3,523,168 | 8/1970 | Holmes | 200/153 J |
| 3,790,726 | 2/1974 | Brown | 200/153 LB |
| 3,971,904 | 7/1976 | Ward | 200/153 LB |
| 4,025,738 | 5/1977 | Erwin et al. | 200/153 LB |

*Primary Examiner*—Stephen Marcus
*Assistant Examiner*—Ernest G. Cusick
*Attorney, Agent, or Firm*—Larry J. Palguta

[57] ABSTRACT

An improved push-push switch (10) suitable for complete automatic assembly is disclosed. The push-push switch (10) contains essentially two moving parts comprising an actuator (50) and a cam (60), the cam (60) coupled by keyway connections (63) for rotation with the actuator (50). Switch contacts (43, 47, 49) are located adjacent the moving switch parts in order to effect a make and break type of switch operation. The actuator (50) has interior (56) and exterior (54) gear teeth which mesh with cover gear teeth (36) and housing gear teeth (14), respectively, to effect rotation of the actuator (50) and the cam (60). The configuration of the cover gear teeth (36) and the associated interior actuator gear teeth (56) provide an axial over-travel of the actuator (50) without effecting any appreciable rotational movement of the actuator (50), thereby compensating for accumulated manufacturing tolerances without affecting switching functions relative to axial displacement of the actuator (50). Rounded and shape edged cam surfaces (64, 65, and 66, 67) produce the same tactile "feel" during the inward axial movements of the actuator (50), whether the switch contacts (47, 49) are being opened or closed.

14 Claims, 14 Drawing Figures

PUSH-PUSH SWITCH

TECHNICAL FIELD

This invention relates to a push-push switch, the method of its operation, and the process for producing such a switch.

BACKGROUND ART

The prior art has proposed push-push on-off switches which produce rotation of an operator which in turn controls the switch contacts. A push-push on-off switch is especially useful in low power requirement switching operations such as switching between AM-FM channels and other such applications generally found in automotive radios. Typical of this application is that illustrated in U.S. Pat. Nos. 4,293,751 and 4,318,221 entitled "Process for Producing an On-Off Push Switch and Resulting Article," inventors John D. VanBenthusen and Carlton M. Osburn and commonly assigned.

Other on-off switching mechanisms are illustrated in U.S. Pat. No. 3,266,991 entitled "Indexing Device for a Rotary Snap Switch," inventor Robert E. Hartsock, assigned to United Car Fastener Corporation and illustrating a floatable rotary switch-operating element manually displaced between two coacting sets of gear teeth, the rotary element being operatively associated with one gear element at one position, and manually displaced axially to engage a second set of complementary teeth. The purpose of these on-off rotary switches is to produce a switch which is relatively compact and useable for low power operations.

In an earlier approach illustrated in U.S. Pat. No. 3,204,067 entitled "Push Rotary Switch Construction with Lost Motion Contact Coupling," inventor William L. Brown and assigned to Boyne Products, Inc., there is illustrated a plunger operated rotary switch successively indexed by rotary operation responsively to a stroke operation of the plunger.

An early illustration of a push button switch is found in U.S. Pat. No. 1,061,578 entitled "Push Button Switch," inventors Heinrich Wischhusen and Alexander Hepke. Other related push button electrical switches illustrate the development of the art wherein an externally operable plunger is manually displaced to effect angular or rotary switch action, such as U.S. Pat. No. 2,798,907 entitled "Electric Switches," inventor Hans Wernhard Schneider and U.S. Pat. No. 2,945,111 entitled "Push Button Electrical Switch," inventor Thomas C. McCormick.

What these prior art references share in common is the attempt to produce a simple, externally operated push-push switch in which one complete push actuation of the manually operated portion of the switch effects a first switch operation followed by a second depression or push to effect an opposite switch action. Obviously, such a switch must be protectively housed and contain the functional components within such housing, and all components being operated by external means.

It is the essential purpose of the present invention to reduce the number of components of a typical push-push switch, as for example the ones illustrated in U.S. Pat. Nos. 3,204,067; 4,293,751; and 4,318,211, and advancing the art of assembly by obviating mechanical fasteners and relying instead upon locking elements comprising interfitted components of the switch.

DISCLOSURE OF THE INVENTION

The present invention comprises a push-push switch having an externally operable switch shaft which when depressed a first time effects a switch operation and when depressed a second time effects an opposite switch operation. The switch includes a housing having a first set of gear teeth, and a switch-actuator having a complementary set of gear teeth coating with the housing gear teeth. The switch actuator is effective for axially biasing the actuator gear teeth out of engagement with the housing gear teeth, and against the resistance of a resilient spring, so that a second set of gear teeth within the switch actuator is brought into cooperative engagement with a complementary set of gear teeth of a component forming a cover for the switch housing. Thus, the switch actuator moves floatably between two positions, at one position a set of gear teeth formed at the actuator's exterior surface being in engagement with a complementary set of gear teeth of the housing and at a second axial position a different set of gear teeth formed interiorly of the actuator are engaged operatively with gear teeth on the cover. The switch actuator effects limited rotational movement of a cam and the cam in turn effects opening or closing of a pair of resilient switch arms disposed within the push-push switch housing.

Through the configuring of the cam surfaces and the teeth of the actuator, housing and cover, there is imparted a "switch feel" at which the switch becomes operative at a certain axial position of the switch actuator. Also, by configuring the gear teeth on the cover member in relation to the configuration of the internal gear teeth of the actuator, it is possible to effect limited axial lost motion movement of the switch actuator without any rotational movement of the cam. This lost movement provides a compensation for manufacturing tolerances in assembly of the push-push switch.

The switch consists of only two moving parts and the contacts are suspended at a protected location within the housing where they are free from debris, dust, and other contaminants which can adversely affect switch operation. Since the switch operation always occurs at a given level of depression of the push-push switch actuator, there is a consistency both in the "feel" and displacement of the actuator which contributes to the "feel" of switch operation. The switch is easily assembled because the components of the switch do not rely on locking elements, but instead the cover and the housing have integral interlocking snap-together parts. The snap-together parts are mechanically interfitted and interlocked.

BEST MODE FOR CARRYING OUT THE INVENTION

Figures 1, 2:
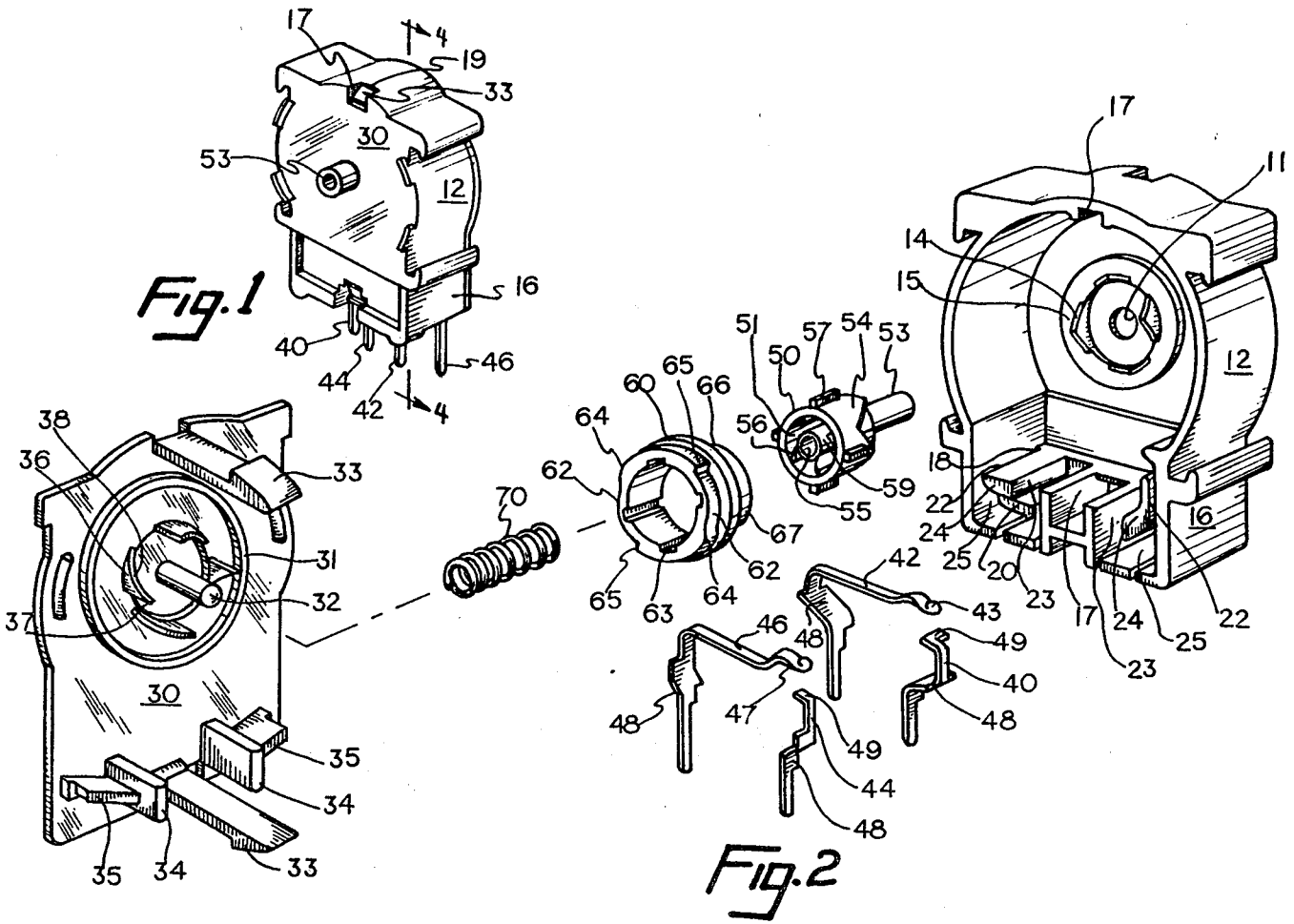
FIG. 1 is an isometric view of the push-push switch.
FIG. 2 is an isometric exploded view of the switch illustrating the housing, actuator, cam, resilient spring, contacts, and cover.

Referring now to the drawings and particularly FIGS. 1 and 2, the push-push switch, designated generally by reference numeral 10, consists of a switch housing 12 having a plurality of circumferentially spaced serrated gear teeth 14 and spaced apart switch seats 18 and 20 at the base 16 of the housing, the seats consisting of slots 22 formd within bosses 24 of the housing. Slots 22 receve the base portions 48 of resilient switch arms 40, 42 and 44, 46. Ends of the switch arms project exteriorly of the housing 12 to form the terminal connections of the switch 10. Switch arms 40–46 are "preloaded" when assembled in the positions illustrated in FIGS. 3–6, by endwise insertion in the slots 22. Switch arms 42 and 46 have respective contacts 43, 47 engaged by a cam 60 in a manner later to be described, the cam 60 depressing the switch contacts 43, 47 (FIG. 3) to separate them from the fixed contacts 49 of switch arms 40 and 44, the contacts 43 and 47 being positioned in engagement with the undersurfaces of fixed contacts 49.

The described switch opening and closing is effected by an actuator 50. The actuator 50 has two sets of gear teeth, one serrated set of exterior gear teeth 54 which coact with the gear teeth 14 of the housing 12, and an interior set of gear teeth 56 operatively associated with gear teeth 36 of the cover 30. Each cover gear tooth 36 has a curved lobe 37 and sloping side 38 contoured to effect rotation of the actuator when the actuator is depressed against the action of the spring 70. The manner in which the two sets of gear teeth 54, 56 are operative, can best be understood from a complete cycle of switch operation hereinafter described and which occurs when the actuator shaft 53 extending through housing aperture 11, is manually depressed against the resistance of spring 70 bearing against the cover 30 at one end and captured within a seat 52 (FIG. 4) formed by a recess 51 and interior actuator shaft 59.

The switch actuator 50 is mounted for axial and rotational movement on an axial projection 32 integrally formed with the cover 30 and extending within a central bearing opening 55 of the actuator 50. The limits of axial movement of the actuator are defined by engagement of exterior gear teeth 54 with housing gear teeth 14 and interior gear teeth 56 with cover gear teeth 36. When external axial forces depressing the actuator are removed, spring 70 returns the actuator to an initial position where the exterior gear teeth 54 are fully internested with housing gear teeth 14.

The cover 30 has integral snap-together projections 33 received in housing passageways 17, the ends of the projections engaging the housing abutments 19 to secure the cover 30 to the housing 12.

Cover 30 has seat projections 34 and 35 received in housing slots 23 and 25 (FIG. 2), respectively, to trap and fix the base portions 48 of switch arms 40, 42 and 44, 46 in the housing 12.

One complete cycle of depressing the actuator 50 and its subsequent return by the spring 70, effects a one quarter turn or 90° rotation of the actuator 50. The actuator 50 is coupled to the cam 60 through keys 57 received by cam keyways 63. The cam 60 has cam surfaces 64, 65 and 66, 67 which engage the switch contacts 47 and 43, respectively, to displace the contacts between open and closed positions with fixed contacts 49. One cycle of depression and return of the actuator 50 causes an opening of a set of contacts 43, 49 or 47, 49 and the next succeeding cycle of operation causes an opposite switch operation comprising a closing of the set of contacts. When one of the sets of contacts 43, 49 and 47, 49 is closed, the other set is open as shown by comparing FIGS. 3 and 5. The sequence of switch contact operation may be altered by modifying the circumferential positions of cam surfaces 64, 65 relative to cam surfaces 66, 67. The cam 60 is supported for rotation on a bearing surface 15 formed in the housing 12. The cam can float slightly between a lubricated land 31 on the cover 30 and the bearing surface 15.

OPERATION

Figure 4:
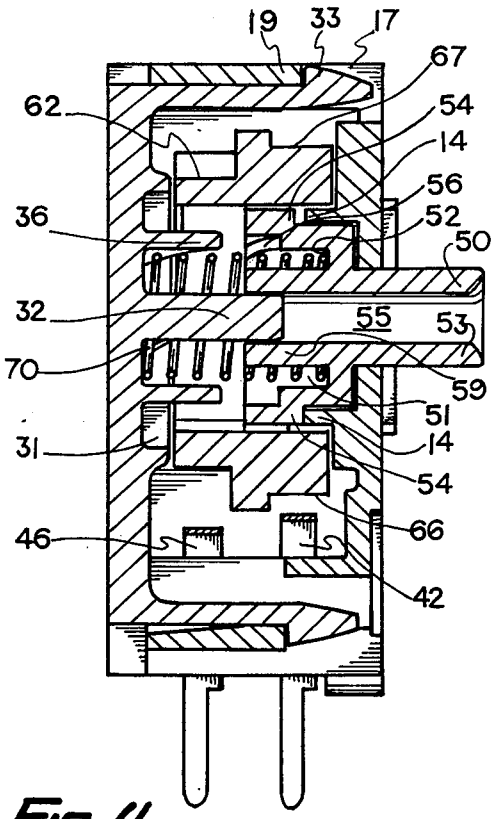
FIG. 4 is a section view along lines 4—4 of FIG. 1 and shows the actuator in a fully extended position.
Figure 3:
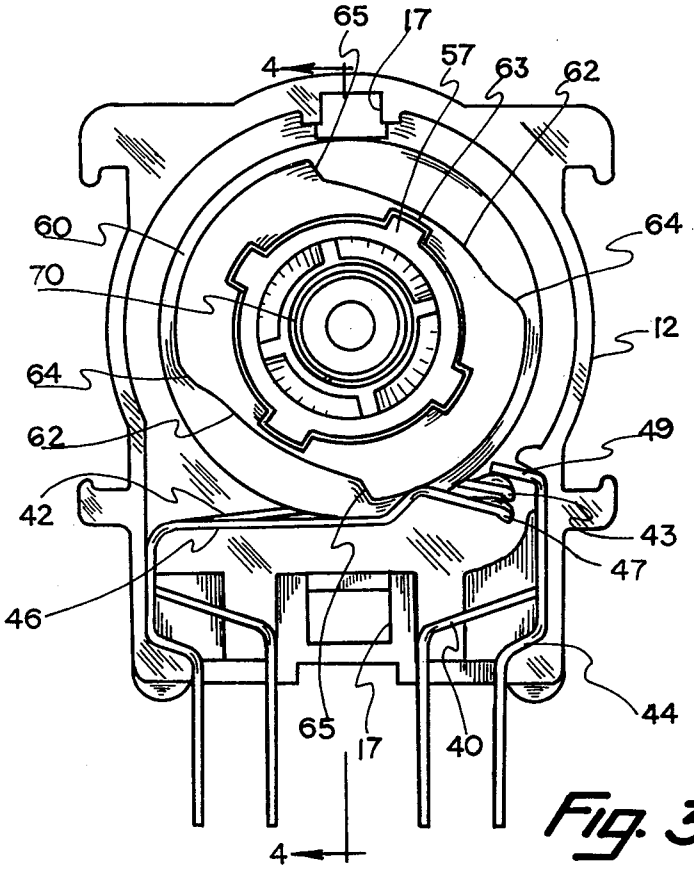
FIG. 3 is a rear view of the switch with the cover removed.

FIGS. 3–6 illustrate the operation of the switch parts when the actuator 50 is displaced from its initial at rest position where the serrated set of exterior gear teeth 54 internest with the housing gear teeth 14. FIGS. 3 and 4 illustrate the actuator in the fully extended position; FIG. 4 being a section view illustrating that the housing gear teeth 14 are disposed circumferentially at an angle relative to the center line of the housing 12 (see FIG. 2). FIGS. 3 and 4 illustrate switch contact 43 of switch arm 42 in contact with fixed contact 49 of switch arm 40, and switch contact 47 of switch arm 46 disengaged from fixed contact 49 of switch arm 44. Switch contact 47 of arm 46 engages the cam surface 65 which effects disengagement of switch contact 47 from the fixed contact 49 of switch arm 44, and switch contact 43 of arm 42 engages fixed contact 49 of arm 40.

The actuator 50 is maintained at its initial position by resilient spring 70 which biases the serrated set of exterior gear teeth 54 into engagement with the housing gear teeth 14.

Figure 6:
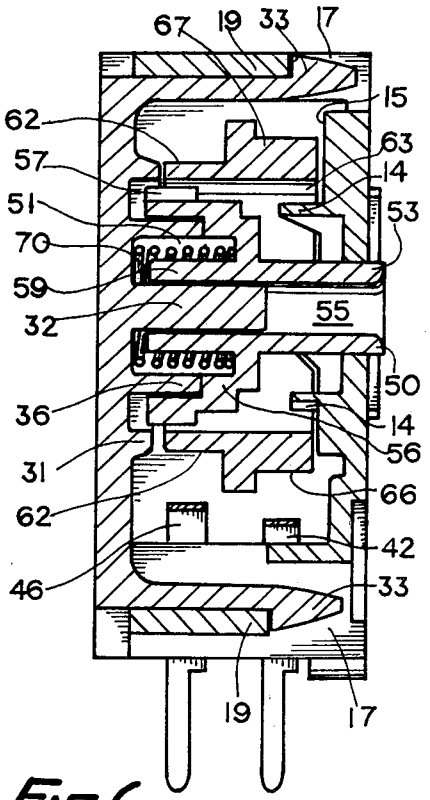
FIG. 6 is a section view taken along lines 6—of FIG. 5 with the cover attached to the housing and illustrates the actuator in a fully depressed position.
Figure 5:
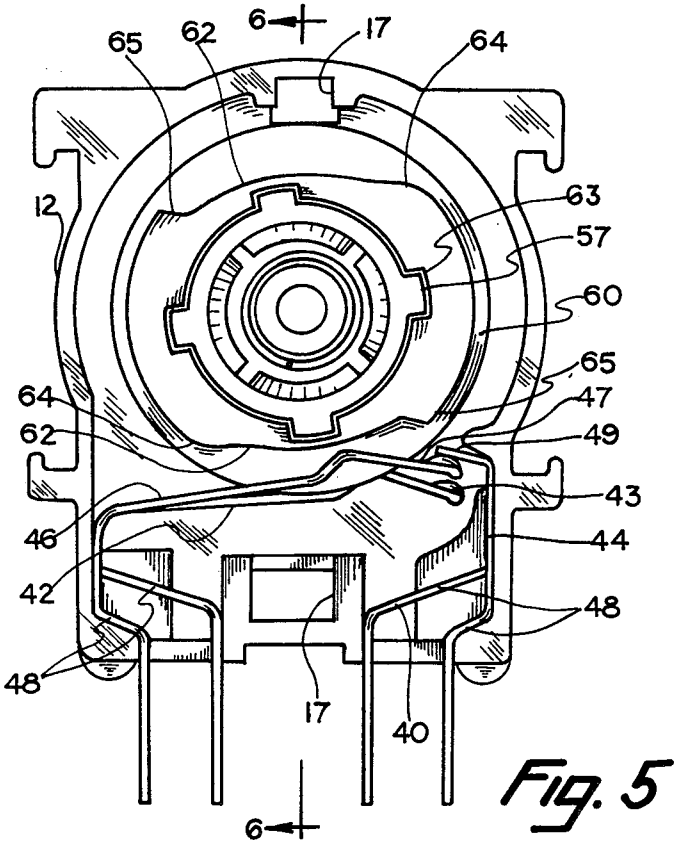
FIG. 5 is a rear view of the switch with the cover removed and the actuator fully depressed.

FIGS. 5 and 6 illustrate full depression of the actuator 50 so that the exterior gear teeth 54 are completely disengaged from the housing gear teeth 14. The actuator 50 is guided for axial movement by projection 32 received in opening 55 of the actuator. Depression of the actuator 50 effects engagement of the interior actuator gear teeth 56 with cover gear teeth 36, engagement of these teeth effecting rotation of the actuator. As the actuator rotates, it drives the cam through the interconnection of the actuator keys 57 and cam keyways 63. FIG. 5 illustrates that upon full depression, the cam 60 has rotated in a counterclockwise direction, such that contact 47 of switch arm 46 disengages cam surface 65. The smaller radius cam surface 62 allows switch contact 47 to spring upwardly into engagement with fixed contact 49 of arm 44 to complete a ciruit across switch arms 46 and 44. Likewise, switch contact 43 of switch arm 42 engages cam surface 66 (FIG. 2) on the other side of cam 60, cam surface 66 having a larger radius than its complementary smaller radius cam surface 62 (not shown), and contact 43 of switch arm 42 is biased out of engagement with fixed contact 49 of switch arm 40. It should be understood that the alternating opened and closed positions of the switch contacts 43, 47 and fixed contacts 49 of the respective switch arms, can be changed by modifying the circumferential positions of the associated cam surfaces located on the opposite sides of cam 60. Thus, by circumferentially repositioning cam surfaces 64, 65 and/or 66, 67, the switch contacts 43 and 47 of the respective contact arms can engage and disengage the associated fixed contacts 49 at the same time, or in any other sequence relative to the actuator stroke.

FIGS. 4–6 illustrate the securement of the cover 30 to the housing 12. Cover projections 33 are received by passageways 17 and snap-fit engage the housing abutments 19. Thus, the switch 10 may be assembled by: inserting the actuator shaft 53 through the housing aperture 11 so that the exterior gear teeth 54 internest with housing gear teeth 14, positioning the cam 60 about the actuator whereby the keys 57 are received in cam keyways 63, placing the spring 70 into recess 51 about interior shaft 59, and then inserting axial projection 32 into the spring 70 and the actuator opening 55. The cover projections 33 are received in housing passageways 17, and as the projections 33 are inserted through the passageways, the cover 30 compresses the spring 70. Projections 33 engage abutments 19 to lock the cover to housing 12 and retain the spring under compression for continuously biasing the actuator 50 into engagement with the housing teeth 14.

FIGS. 7–13 illustrate in detail the operation of the respective sets of gear teeth as the switch 10 operates through a full cycle of operation. FIGS. 7–13 are partial cut-away views of the actuator 50, housing 12, and cover 30, and are taken along the center line of the housing teeth 14, and thus the cover gear teeth 36 are illustrated in off-center position. The housing gear teeth 14 are disposed circumferentially at an angle relative to the center line of the housing 12, but for convenience, FIGS. 7–13 are taken along a center line passing through the gear teeth 14.

Figure 7:
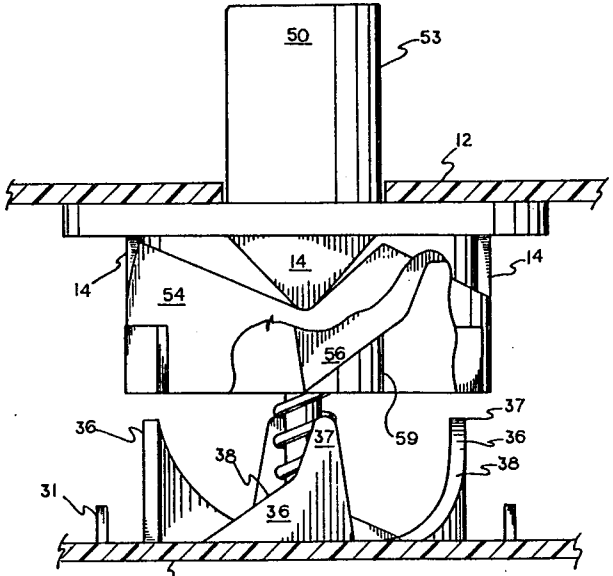
FIGS. 7–13 are partial cut-away progressive views of the switch illustrating the operation of the switch from its initial position when the exterior gear teeth of the actuator fully engage the teeth of the housing; and, FIG. 14 is a graph illustrating the actuator stroke (in relative units) versus angular movement of the actuator ($\phi$).
Figure 8:
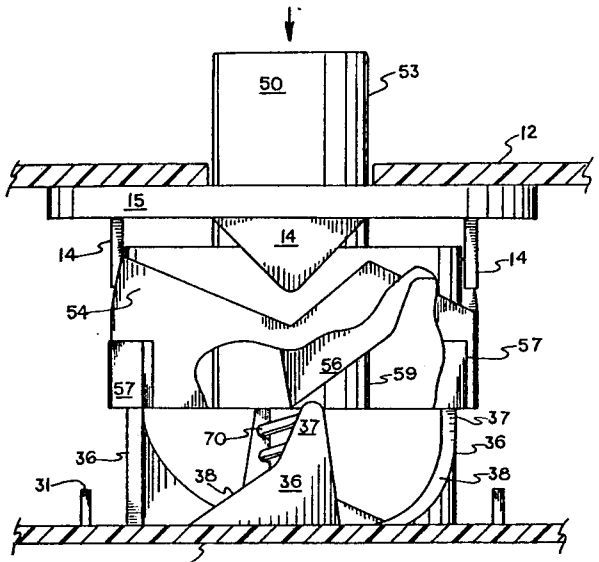

FIG. 7 illustrates the actuator in the extended position wherein the exterior gear teeth 54 intermesh with housing gear teeth 14, the actuator being biased in an upward direction by the resilient spring 70. Cover gear teeth 36 have a constant cross section so that the sloping sides 38 do not cause actuator switch parts to be biased inwardly or outwardly, thereby avoiding canting or twisting of the teeth out of perpendicularity. The partial cut-away of FIG. 7 illustrates an interior gear tooth 56 positioned relative to cover gear teeth 36. As the actuator 50 is depressed or retracted into housing 12 (see FIG. 8), exterior gear teeth 54 disengage from housing gear teeth 14 and interior gear teeth 56 approach the respective lobes 37 of cover gear teeth 36, all without any rotation of the actuator.

Figure 9:
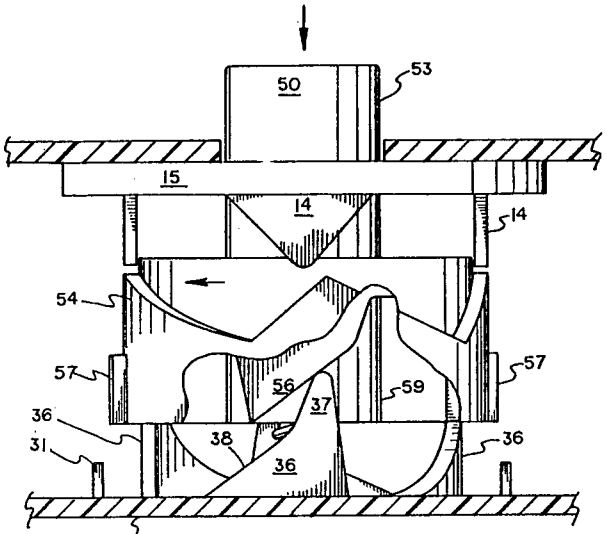

FIG. 9 illustrates further retraction of the actuator 50 such that interior gear teeth 56 have engaged the respective lobes 37 of cover gear teeth 36 to effect rotation of the actuator. Exterior gear teeth 54 of the actuator 50 have disengaged housing gear teeth 14 so that as actuator 50 rotates, the tips of the exterior gear teeth 54 clear the tips of the housing gear teeth 14.

Figure 10:
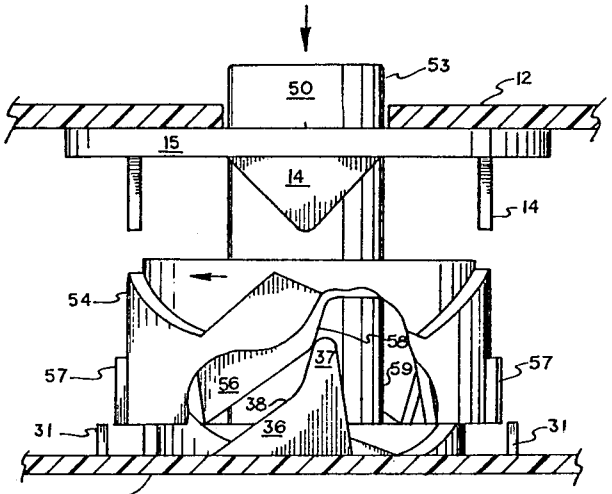

FIG. 10 illustrates further retraction and rotation of the actuator whereby interior gear teeth 56 are in their terminal phase of rotational engagement with respective cover gear teeth 36. Complementary shaped gear teeth 56 and 36 are formed such that at the terminal phase of depressing the switch actuator 50, there is very little rotatinal displacement of the actuator but the actuator may be displaced axially still further. The sloping surfaces 38 of the gear teeth 36 and surfaces 58 of teeth 56 are designed to compensate for accumulated manufacturing tolerances, and thus allow for further axial movement of the actuator without any appreciable rotation.

Figure 11:
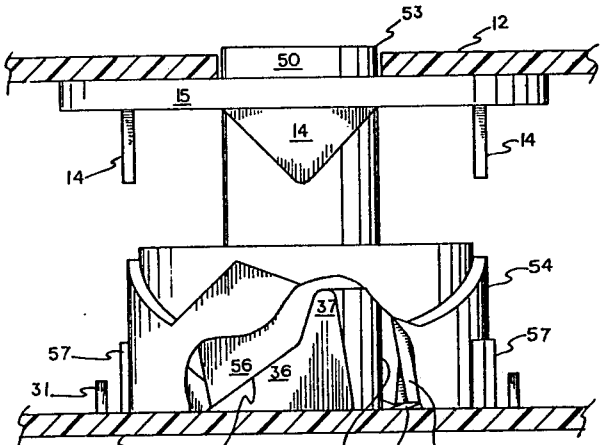

FIG. 11 illustrates full depression or retraction of the actuator 50 such that interior gear teeth 56 intermesh with associated cover gear teeth 36.

Figure 12:
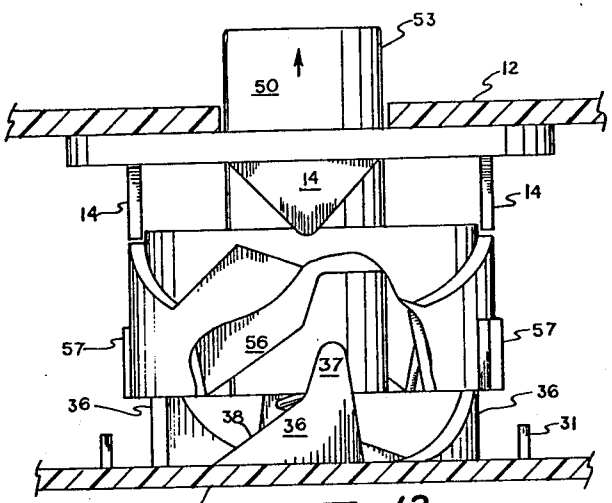

FIG. 12 illustrates the return movement of the actuator stroke effected by spring 70 as the retraction force is removed from actuator shaft 53. Resilient spring 70 biases the actuator upwardly and the interior gear teeth 56 disengage from gear teeth 36 without rotation of the actuator.

Figure 13:
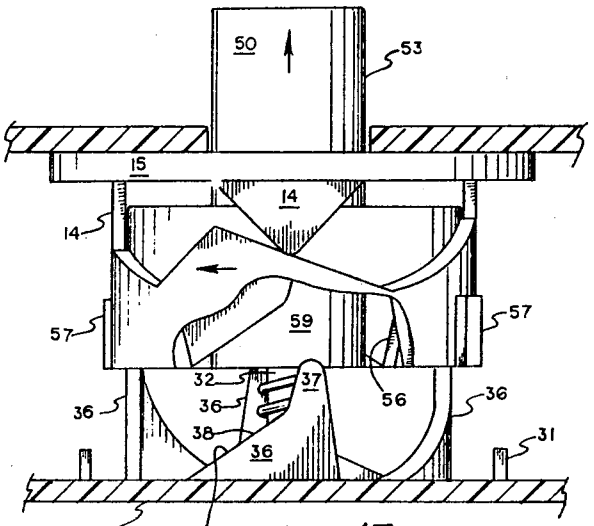

FIG. 13 illustrates the further extension and return of the actuator toward its initial position. Exterior actuator gear teeth 54 have reengaged housing gear teeth 14 to effect rotation of the actuator and a corresponding rotation of the cam 60. Finally, actuator 50 returns to the position shown in FIG. 7 wherein exterior gear teeth 54 internest with housing gear teeth 14.

Figure 14:
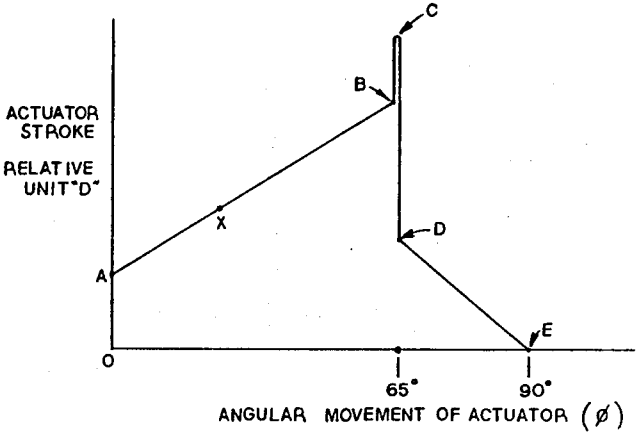

FIG. 14 is a graph illustrating the full cycle of actuator stroke as described above, wherein the actuator stroke is plotted on the ordinate and the angular displacement of the actuator is plotted on the abscissa. The actuator stroke commences with only axial displacement of the actuator (see FIG. 8) until point A on curve O-E is reached, at which point rotational displacement commences when interior gear teeth 56 engage cover gear teeth 36. Rotational movement occurs simultaneously with axial displacement of the actuator until the nominal stroke at point B is reached. It should be understood that the making or breaking of the switch contacts occurs at approximately point X along portion A-B of curve O-E. The actuator stroke may continue without further appreciable rotational or angular displacement as illustrated by portion B-C of the curve. This portion of the actuator stroke allows for the build-up of manufacturing tolerances as illustrated by FIG.10, and point C represents the maximum stroke of the actuator (see FIG. 11).

The return portion of the actuator stroke is illustrated by portions C-E of curve O-E. The actuator returns axially without any rotational movement (FIG. 12) until approximately point D where the exterior actuator gear teeth 54 reengage the housing gear teeth 14 (FIG. 13), and angular rotation of the actuator occurs until point E where the actuator has returned to its at initial rest position (FIG. 7). One full cycle of actuator operation effects 90° of angular displacement of the actuator and coupled cam. The design of the switch may be altered and changed according to the particular application and customer requirements, and thus the point at which the switch contacts make or break, the commencement of angular rotation relative to the stroke, and the amount of angular rotation relative to the stroke, may be varied according to the particular application.

The improved push-push switch of the present invention accomplishes numerous objects, all contributing to complete automatic assembly of the switch. The respective gear teeth, particularly the cover gear teeth, have a constant cross section so that there are no tangential biasing forces exerted against other switch parts, and the swith has essentially two moving parts comprising the actuator and the cam. The switch contacts are disposed at the side of the moving switch parts so that a make and break type of switch operation is utilized at an interior switch location where the switch contacts are not subject to contamination and fouling. The sloping surfaces of the cover gear teeth and the associated interior gear teeth provide an axial overtravel of the actuator without any appreciable rotational movement, thereby compensating for accumulated manufacturing tolerances without affecting switching functions relative to axial displacement of the actuator. The rounded and sharp edged cam sufaces 64, 65 and 66, 67 produce the same tactile feel, and thus the switch has the same detent or tactile "feel" at the same point of inward movement of the actuator whether the switch contacts are being opened or closed.

The switch may be easily assembled by the snap-together fitting of the housing and the cover, this securement effecting also a trapping of the switch arms within their respective housing slots by the interfitment of the cover seat projections into the housing slots. Thus, the improved push-push switch utilizes only a minimum number of parts readily assembled by automatic assembly equipment and methods.

INDUSTRIAL FIELD

The improved push-push switch may be utilized for switching operations utilizing an axial displacement to effect switch operation.

CONCLUSION

Although the present invention has been illustrated and described in connection with one example embodiment, it will be understood that this is illustrative of the invention, and it is by no means restrictive thereof. It is reasonably to be expected that those skilled in the art can make numerous revisions and additions to the invention and it is intended that such revisions and additions will be included within the scope of the following claims as equivalents of the invention.

We claim:

1. A switch comprising a housing having integrally formed regularly spaced gear teeth on an interior housing surface, a pair of conductive engagable and disengagable switch arms mounted within said housing, actuator means having a plurality of internal gear teeth and regularly spaced external gear teeth complementary with the gear teeth of said housing, a stationary backing spaced from said housing surface and having a plurality of gear teeth, the gear teeth of said stationary backing complementary with said internal gear teeth, means for mounting said actuator means in an axial floatable relation between said housing and stationary backing, resilient spring means positioned to bias the external gear teeth of said actuator means into engagement with the gear teeth of said housing and permitting axial movement disengaging said external gear teeth from the gear teeth of said housing, cam means coupled to said actuator means for rotational movement therewith and including a cam surface for engaging one of said switch arms, and means for effecting selective axial movement of said actuator means to disengage the gear teeth of the actuator means and housing and bias the internal gear teeth of said actuator means against the gear teeth of said stationary backing to effect angular movement of said actuator means and cam means, said spring means effecting an opposite axial movement of said actuator means whereby said internal gear teeth disengage from the gear teeth of the backing and the external gear teth re-engage the gear teeth of said housing to effect further rotational movement of said actuator means and cam means.

2. The switch in accordance with claim 1, wherein the cam means selectively effects opening and closing of said switch arms.

3. The switch in accordance with claim 1, wherein the internal gear teeth of said actuator means and the gear teeth of said stationary backing are shaped to provide continued axial movement of said actuator means unaccompanied by any substantial rotational motion at the terminal phase of engagement.

4. The switch in accordance with claim 1, wherein said cam surface and associated switch arm are configured to impart a tactile feel to switch operation.

5. The switch in accordance with claim 1, further comprising means for snap-together fitting of said housing and backing.

6. The switch in accordance with claim 1, wherein the switch arms are mounted in said housing and further secured by the attachment of said backing to said housing, to prevent switch arm movement from the respective mounting.

7. The switch in accordance with claim 1, wherein the cam surface is configured so that each axial movement engaging the gear teeth of the actuator means and stationary backing effects an identical tactile feel to switch operation as a switch arm is engaged or disengaged by the cam surface.

8. A method of switch operation for engaging or disengaging switch contacts, comprising the steps of (1) depressing a switch element accessible externally of a switch housing to effect axial displacement of an internal actuator whereby exterior actuator gear teeth disengage complementary gear teeth of the switch housing, (2) transferring internal gear teeth of said actuator into engagement with gear teeth of an axially spaced stationary backing through means mounting said actuator for axial displacement, (3) opposing said axial displacement with biasing means providing resistance to said axial displacement, (4) effecting a predetermined rotational movement of said actuator by means of the internal gear teeth intermeshing with the gear teeth of the backing whereby a switch operating cam rotates with said actuator to effect engagement or disengagement of the switch contacts, (5) releasing said switch element so that the biasing means effects displacement of said actuator in an opposite axial direction. (6) disengaging said internal gear teeth from the gear teeth of the axially spaced stationary backing and reengaging the exterior actuator gear teeth with the complementary gear teeth of the switch housing to effect further rotation of said actuator and its operatively connected cam.

9. The method in accordance with claim 8, including the step of repeating steps (1) through (6) to effect disengagement of previously engaged contacts.

10. The method in accordance with claim 8 or 9, further comprising the step of engaging a movable switch arm with a predetermined cam surface of said cam to effect the same resistance to axial displacement of said switch element during each switch operation.

11. The method of claim 8, further comprising the step of effecting a snap-together fitting of said backing and housing in order to secure the axially spaced stationary backing in engagement with said switch housing for said switch operation.

12. The method of claim 8, further comprising the step of axially displacing said actuator along a projection integral with said stationary backing and received in a coaxial opening in said actuator.

13. The method of claim 8, further comprising the step of securing switch contacts in position for switch contact operation by interference fitting protrusions of said spaced stationary backing into receptacles of the switch housing and against switch arms disposed in the receptacles and integral with the respective switch contacts.

14. The method of claim 8, further comprising the step of providing continued axial displacement of said actuator without any substantial rotation of the actuator during the terminal phase of depressing the switch element.

* * * * *